US006227700B1

(12) United States Patent
Hunziker et al.

(10) Patent No.: US 6,227,700 B1
(45) Date of Patent: May 8, 2001

(54) PUSH BUTTON DEVICE FOR A TIMEPIECE, IN PARTICULAR A CHRONOGRAPH

(75) Inventors: Yannick Hunziker, Delémont; André Nussbaum, Bienne; Jean-Philippe Rebeaud, Cressier, all of (CH)

(73) Assignee: Eta Sa Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/310,189

(22) Filed: May 12, 1999

(30) Foreign Application Priority Data

May 13, 1998 (CH) ..... 1062/98

(51) Int. Cl.[7] ..... G04B 29/00
(52) U.S. Cl. ..... 368/321
(58) Field of Search ..... 368/319–321, 368/190

(56) References Cited

U.S. PATENT DOCUMENTS 1,926,243 * 9/1933 Russo ..... 368/190
3,377,796 * 4/1968 Rogers ..... 368/319
4,536,095 8/1985 Wuthrich et al. .
4,932,011 6/1990 Schwartz .
5,043,958 * 8/1991 Kaelin ..... 368/321
5,521,890 * 5/1996 Miche et al. ..... 368/321

FOREIGN PATENT DOCUMENTS

470704 * 12/1968 (CH) ..... 368/190
392 307 10/1990 (EP) .
655664 5/1995 (EP) .

* cited by examiner

*Primary Examiner*—Bernard Roskoski
(74) *Attorney, Agent, or Firm*—Sughrue, Mion, Zinn, Macpeak & Seas, PLLC

(57) ABSTRACT

The invention concerns a push button device for a timepiece, in particular a chronograph, including a pusher head (2) associated with a pusher stem (4) arranged so as to slide in a recess (6) inside which it moves axially from a rest position against the resilient return force of a spring (12) when the pusher head (2) is pushed in, characterised in that the pusher stem (4) is also able to move axially from its rest position to a pulled out position when the pusher head (2) is pulled out.

10 Claims, 4 Drawing Sheets

PUSH BUTTON DEVICE FOR A TIMEPIECE, IN PARTICULAR A CHRONOGRAPH

BACKGROUND OF THE INVENTION

The present invention concerns a push button device for a timepiece used, for example, to start a chronograph in the pushed in position, and allowing time data or a date to be corrected in a pulled out position.

A timesetting device for an electronic watch including a push button having a shape such that it allows the device to he actuated by a user is known from Swiss Patent No. 577 701. The push button comprises a pusher head which is driven onto a pusher stem and held thereon said stem allowing a timesetting device to be actuated. Inside the pusher head is arranged a recess of generally cylindrical shape in which is disposed a return spring which bias the pusher head axially towards an initial rest position. The pusher stem carries a crown which, when the user presses on the pusher head, engages in a recess of a timesetting element attached to the movement of the watch. This element allows high frequency pulses to be supplied to the hour and minute indicators driving means of the watch. The sole function of the push button device disclosed in this Patent is to allow timesetting. Further, it applies to an electronic watch.

Swiss Patent No. 506 115 also discloses a time correcting device for a watch whose pinion and timesetting stem have an axis of rotation perpendicular to the plane of the watch movement, which rules out a chronograph function since the user is obliged to act on the pinion via the back face of the watch case. Moreover, the indexing function of the timesetting stem is defined by a spring attached to the case and co-operating with said stem.

Further, Swiss Patent No. 3647 discloses a timesetting mechanism for a watch including a timesetting pinion, a winding pinion and a timesetting stem. The timesetting stem is provided with a square section via which it engages the winding pinion when it is in the pushed in position, and the timesetting pinion when it is in the pulled out position. This is not a push button device, but a simple timesetting stem with two coaxial pinions.

SUMMARY OF THE INVENTION

An object of the present invention is to provide a push button device for a timepiece allowing the control, from an initial rest position, for example of the start command of a chronograph in a first pushed in position of the push button, and the correction of time related data or a date in a second pulled out position of said push button.

The present invention thus concerns a push button device for a timepiece, in particular a chronograph, including a pusher head associated with a pusher stem arranged so as to slide in a recess inside which it moves axially from a rest position against the return force of a spring when the pusher head is pushed in, characterised in that the pusher stem is also able to move axially from its rest position to a pulled out position when the pusher head is pulled out.

Acccording to an additional feature of the invention, the push button device includes transmission means co-operating with correction means in the pulled out position of the pusher head.

As a result of these features, the present invention provides a push button device by means of which the user can, either, control the start command for example of a chronograph, or adjust the display of time related data (present time, alarm time, etc.) or a date.

According to another advantage of the invention, correction of the data can be performed in an identical manner in either of the left or right rotational directions of the pusher head, which allows one to avoid the risk of errors which affect conventional correction systems in which, depending on the direction in which the adjustment pinion is rotated, data of a first type (for example time data) or data of a second type (for example a date) is modified. Further, it should be noted that data correction can be performed while the chronograph is working. Finally, by proposing combining the chronograph and data correcting or setting functions by means of a single push button device, the invention provides a constructive assembly which is simpler to manufacture and thus less expensive.

According to another feature of the invention, the push button device includes holding means acting against the return force of the spring which tend to return the pusher stem into the pulled out position.

BRIEF DESCRIPTION OF THE INVENTION

Other features and advantages of the present invention will appear more clearly upon reading the following detailed description of an embodiment example of a push button device according to the invention, this example being given solely by way of illustrative and non limiting example, in conjunction with the annexed drawings, in which:

FIGS. 3A to 3C are detailed views of the zone surrounded by a circle in dot and dash lines in FIG. 2 with the pusher stem in the rest position, respectively pulled out and pushed in.

The present invention concerns the general inventive idea which consists in providing a push button device allowing the control, from an initial rest position, of for example the operation of a chronograph (start, stop, resetting to zero) in a first pushed in position, and the correction of time related data, a date or other information in a second pulled out position. The present push button device is described in its application to a timepiece, in particular a chronograph. It goes without saying however, that it can be applied to any other constructive assembly in which it is sought, by means of a single push button, on the one hand to control the start of an electric or mechanical function, and on the other hand to modify the display of a physical magnitude.

Figure 1:
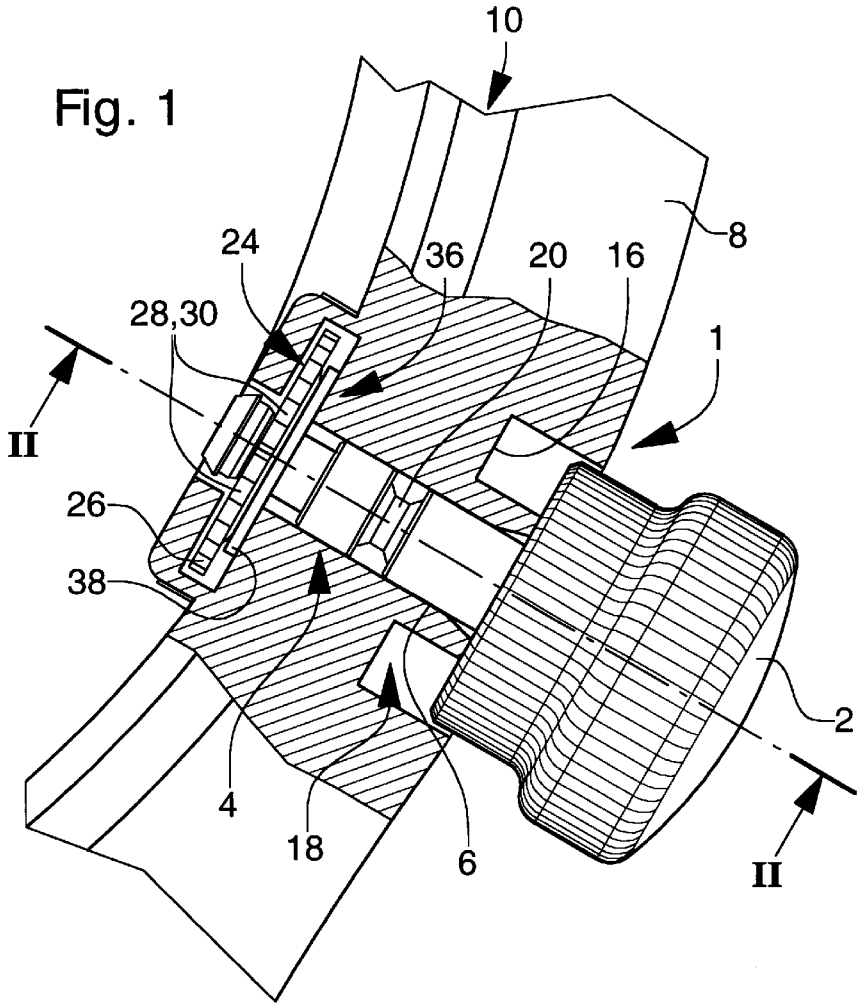
FIG. 1 is a partial top view of a watch case, torn away in the zone of the push button device according to the invention.
Figure 2:
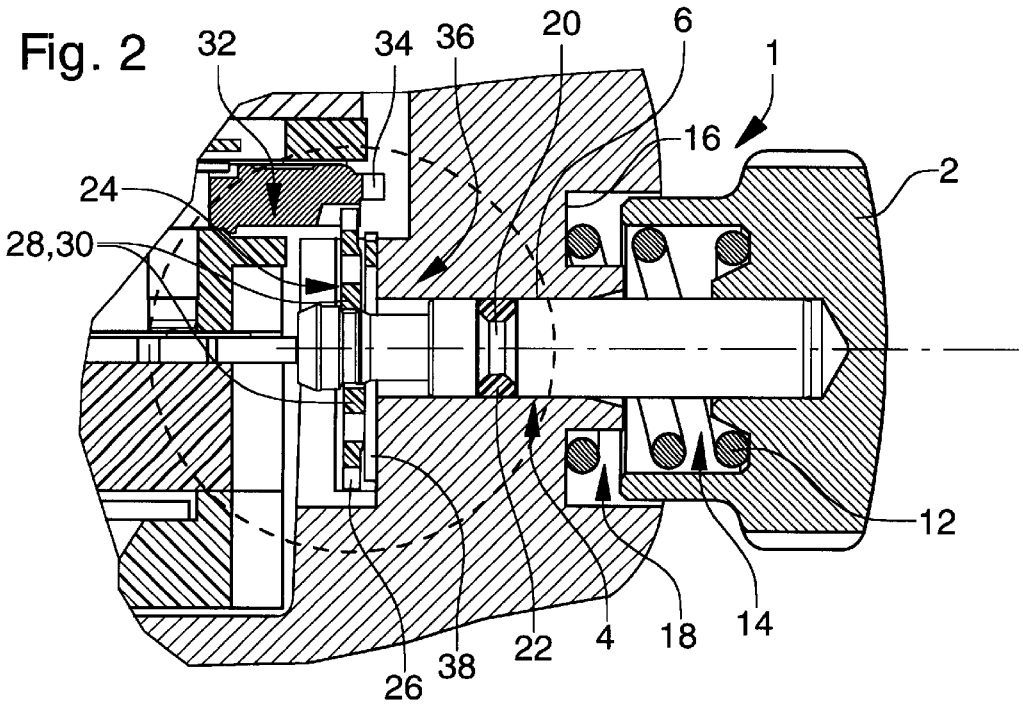
FIG. 2 is a cross-section along the line ll—ll of FIG. 1.

As shown in FIGS. 1 and 2, the push button device according to the invention, designated as a whole by the general numerical reference 1, includes a pusher head 2 held by force, conventionally by being driven into the end of a pusher stem 4. Pusher stem 4 is arranged so as to slide inside a recess 6 of generally cylindrical shape arranged in the middle part 8 of a watch case 10. Stem 4 moves axially in recess 6 against the return force of a spring 12 when a control push is applied to pusher head 2.

Return spring 12 is disposed in a recess 14 arranged in pusher head 2 and rests axially on the base 16 of a cavity 18 provided in middle part 8. Pusher stem 4 has in one location in the length thereof an annular groove 20 in which a sealing gasket 22 is housed. Gasket 22 assures the sealing of recess 6 when stem 4 slides therein when push button device 1 according to the invention is activated by a user.

According to a first feature of the invention, pusher stem 4 is further able to move axially from its rest position into a second pulled out position when a control traction is exerted on pusher head 2.

According to an additional feature of the invention, transmission means 24 are mounted at the end of pusher stem 4 which projects from middle part 8. These transmission means 24 can be constituted for example by a lever or even by a wheel 26 which, according to a simplified variant of the invention, is fixedly mounted on pusher stem 4. Nonetheless, according to the preferred embodiment of the invention, wheel 26 is freely mounted on pusher stem 4 and includes resilient means 28 such as a pair of resilient arms 30 which allow the coupling thereof by friction with said pusher stem 4 when the latter is biased into the pulled out correction position as described in detail hereinafter. Transmission wheel 26 co-operates with data display correction means 32 such as a second wheel 34. Thus, when the user rotates pusher head 2 to the left or right to correct time related data, a date or other information, transmission wheel 26, coupled with stem 4, drives correction wheel 34.

According to another feature of the invention, push button device 1 also includes holding means 36 mounted after transmission wheel 26 on pusher stem 24. These holding means 36 such as preferably a key 38, exerts sufficient force on pusher stem 4 to act against the return force of spring 12 which tends to return pusher stem 4 to the pulled out position and hold the latter in its rest position. Holding means 36 are locked on stem 4, i.e. they have sufficient elasticity to allow the forced passage of pusher stem 4 when the user exerts a control push or traction on pusher head 2 Holding means 36 thus also assure an indexing function for the axial movement of stem 4 which allows the user to know, as a function of the force which he is compelled to exert to overcome the resistance to deformation of holding means 36, that said stem 4 is in the required pushed in or pulled out position.

According to an additional feature of the invention, transmission wheel 26 and key 38 are mounted with a slight axial clearance in a recess 40 arranged in watch case 10, so that they are practically prevented from sliding axially, but free to move in rotation.

Figure 3A:
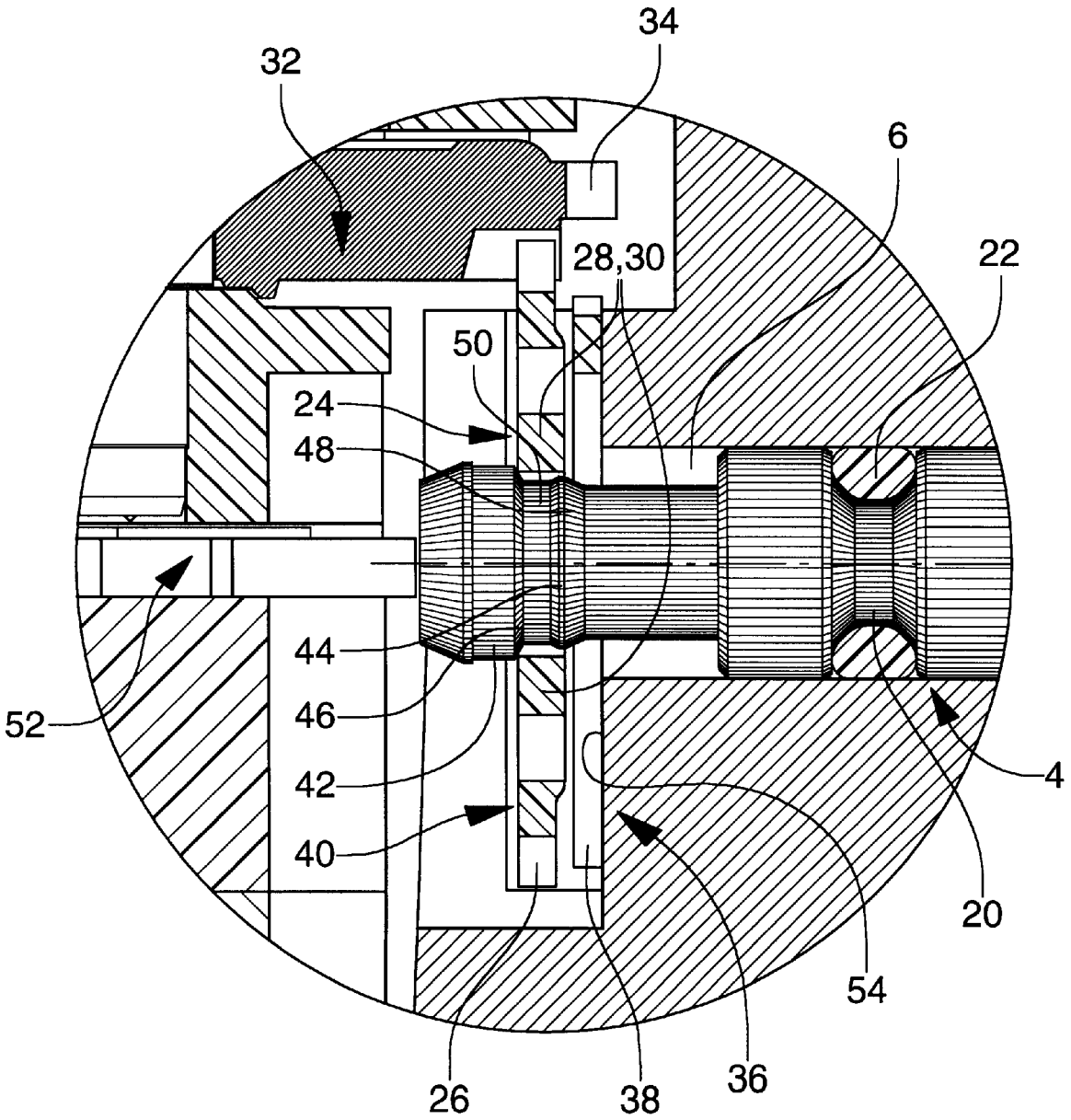
Figure 3B:
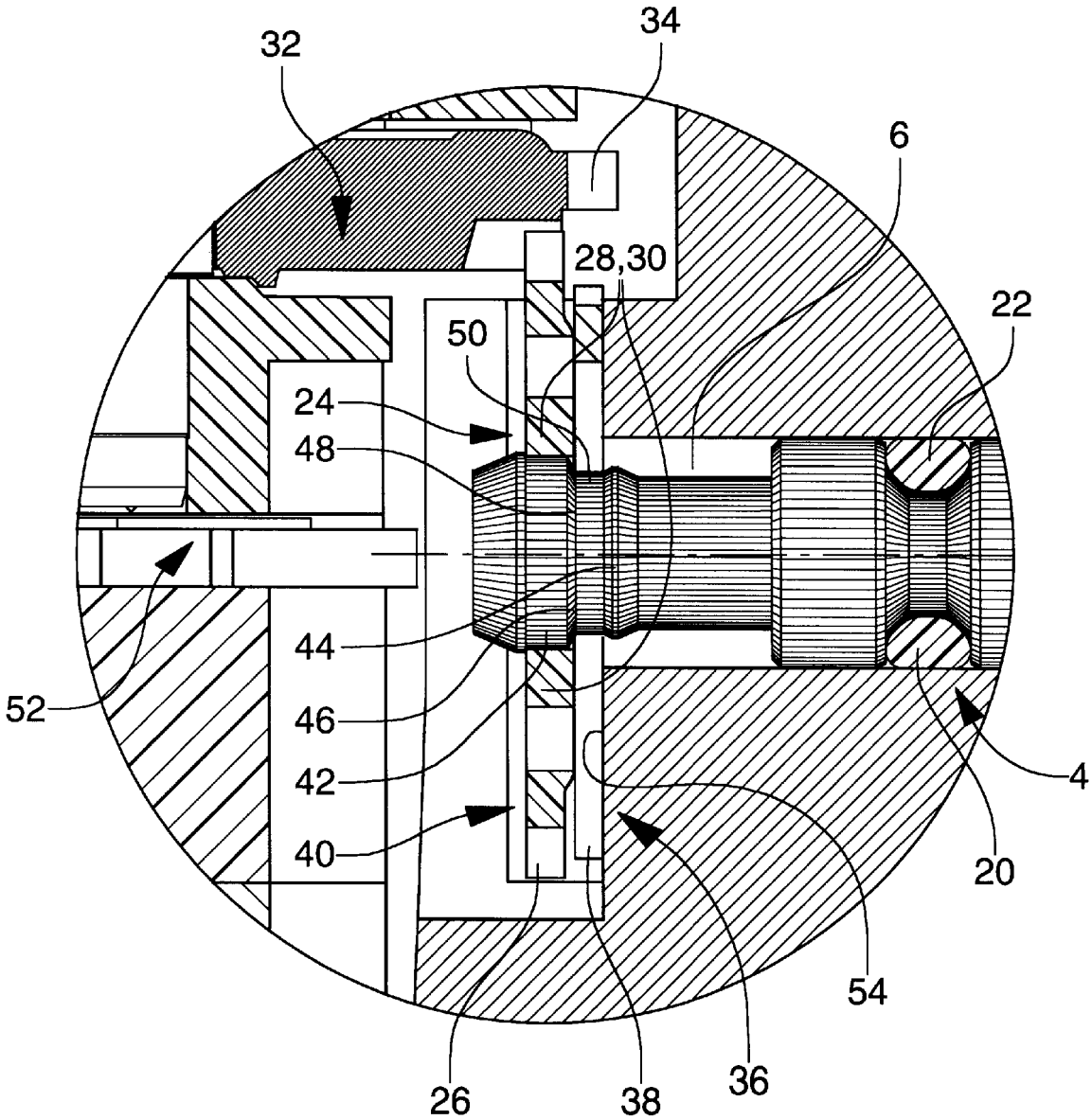
Figure 3C:
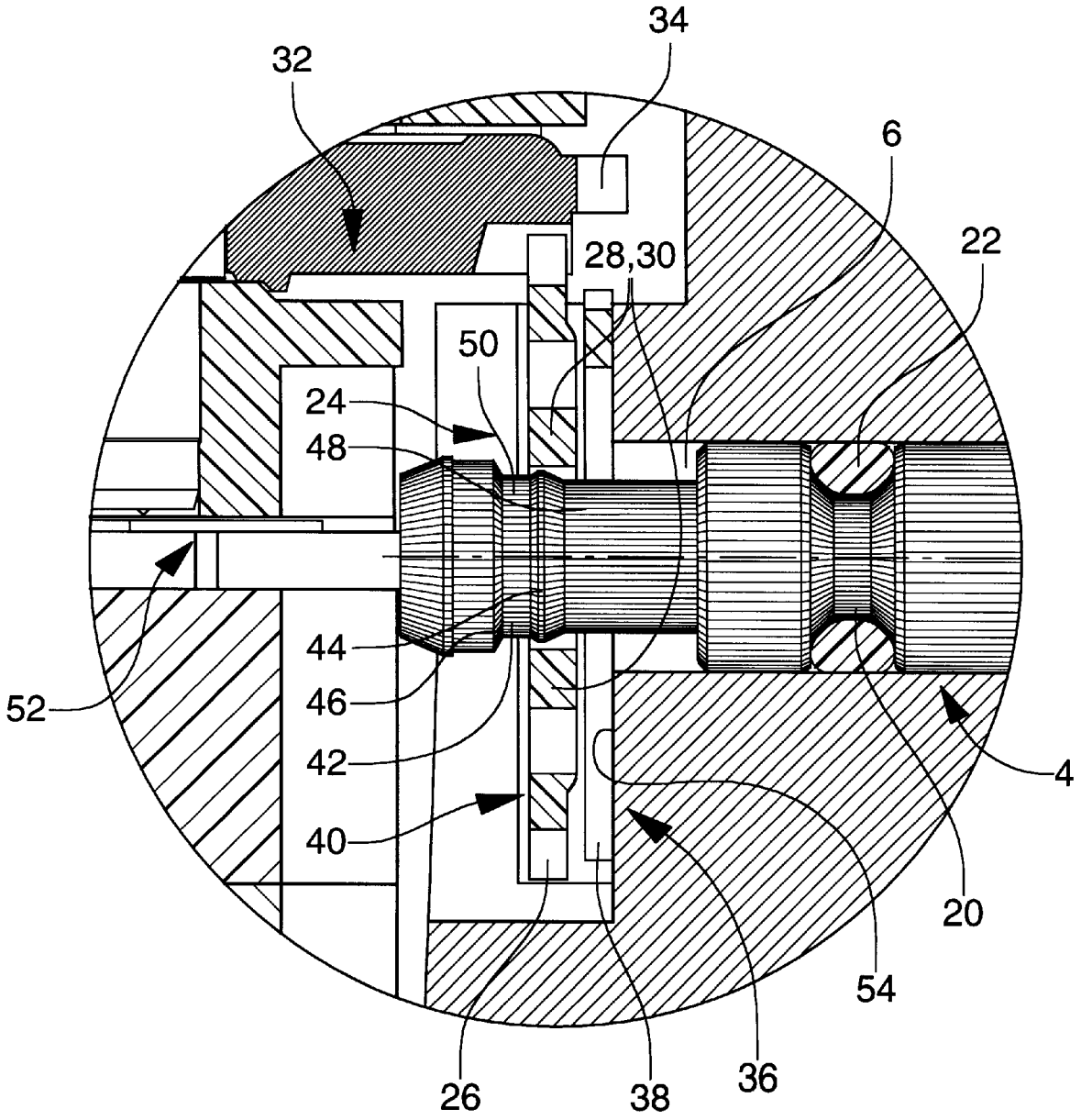

We turn now to the operation of push button device 1 according to the invention with reference to FIGS. 3A to 3C in which pusher stem 4 is shown respectively in its rest, pulled out and pushed in position. As is clear from these Figures, towards the free end thereof which projects from middle part 8, stem 4 has two circular shoulders 42 and 44 connected to said stem 4 by two truncated ramps respectively 46 and 48 separated by an annular groove 50.

In the rest position of pusher stem 4 (FIG. 3A), transmission wheel 26 is idle around annular groove 50. However, when stem 4 is pulled (FIG. 3B), transmission wheel 26 substantially prevented from sliding axially in recess 40, is coupled by friction by its resilient arms 30 onto shoulder 42, this movement of engagement being facilitated by the presence of ramp 44. At this moment, the user can correct time related data, a date or other information simply by rotating pusher head 2 to the left or right. Finally, when the user exerts a control push on pusher head 2 (FIG. 3C), transmission wheel 26 is again idle around pusher stem 4, which acts by the terminal end thereof on a control device 52 such as a spring or an electric contact part controlling, for example, the start, stop or resetting to zero of a chronograph.

It is also seen in FIGS. 3A to 3C that key 38 abuts against a wall 54 of recess 40, so that it generates sufficient force to act against the return force of spring 12 which tends to return pusher stem 4 into the pulled out position and to hold the latter in its rest position. Moreover, when the user pulls or pushes stem 4, key 38 deforms elastically to allow the forced passage of shoulder 42, this engagement movement being facilitated by truncated ramp 46. The axial movement indexing function for stem 4 described hereinbefore is thus achieved.

It goes without saying that various simple modifications and variants fall within the scope of the present invention. It will be understood in particular that when transmission wheel 26 is fixedly mounted on pusher stem 4, it co-operates with a toothing of correction wheel 34 in the pulled out position of pusher stem 4, it being understood that in the rest position or pushed in position of said stem 4, this same transmission wheel 26 is released from the toothing of correction wheel 34.

What is claimed is:

1. A push button device for a timepiece including a pusher head held into an end of a pusher stem arranged so as to slide in a recess inside which said pusher stem moves axially from a rest position against the resilient return force of a spring when the pusher head is pushed in, wherein the pusher stem is also able to move axially from its rest position into a pulled out position when the pusher head is pulled out, and wherein said push button includes transmission means co-operating with correction means in the pulled out position of the pusher stem, said transmission means being freely mounted on the pusher stem and being provided with resilient means to allow the coupling thereof with said pusher stem when the latter is brought into a pulled out correction position.

2. A push button device according to claim 1, wherein the transmission means are formed by a wheel provided with a pair of resilient arms.

3. A push button device according to claim 1, wherein it further includes holding means acting against the return force of the spring which tends to return the pusher stem into the pulled out position.

4. A push button device according to claim 3, wherein the holding means are formed by a key.

5. A push button device according to claim 4, wherein the key is mounted by force on the pusher stem.

6. A push button device according to claim 1, wherein the transmission means and the holding means are arranged in a recess.

7. A push button device according to claim 1, wherein the pusher stem has two shoulders.

8. A push button device according to claim 7, wherein the shoulders are connected to the pusher stem by two truncated ramps respectively.

9. A push button device according to claim 1, wherein in one location in the length thereof the pusher stem has an annular groove in which a sealing gasket is housed.

10. A push button device according to claim 1, wherein the pusher head is driven into the pusher stem and has a recess in which the return spring is housed.

* * * * *